US007404351B1

(12) United States Patent
Peterson et al.

(10) Patent No.: US 7,404,351 B1
(45) Date of Patent: Jul. 29, 2008

(54) FIBERGLASS INSULATION BATT SIZING DEVICE

(75) Inventors: Gunner J. Peterson, 1563 - 16th Ave., McPherson, KS (US) 67460; Brian M. Young, McPherson, KS (US)

(73) Assignees: Gunner J. Peterson, McPherson, KS (US); Kelly Edmond Regier, McPherson, KS (US)

( * ) Notice: Subject to any disclaimer, the term of this patent is extended or adjusted under 35 U.S.C. 154(b) by 176 days.

(21) Appl. No.: 11/039,555

(22) Filed: Jan. 20, 2005

(51) Int. Cl.
*B26D 7/02* (2006.01)
*B26D 1/04* (2006.01)

(52) U.S. Cl. ..... 83/455; 83/614; 83/821; 30/289; 30/294

(58) Field of Classification Search ..... 83/455, 83/614, 821, 414, 565; 30/286, 289, 294; 269/2, 126
See application file for complete search history.

(56) References Cited

U.S. PATENT DOCUMENTS

| | | | | | |
|---|---|---|---|---|---|
| 197,901 | A | * | 12/1877 | Sargent | 83/455 |
| 237,280 | A | * | 2/1881 | Hoopes et al. | 83/455 |
| 614,407 | A | | 11/1898 | Morrison et al. | |
| 697,902 | A | | 4/1902 | Tripp | |
| 1,895,754 | A | * | 1/1933 | Finkenwirth | 83/455 |
| 2,013,893 | A | * | 9/1935 | Matthews | 83/455 |
| 2,755,154 | A | * | 7/1956 | Mele | 312/274 |
| 2,895,600 | A | * | 7/1959 | Nevins | 312/293.2 |
| 3,173,322 | A | | 3/1965 | McHenry | |
| 3,301,117 | A | * | 1/1967 | Spaulding | 83/455 |
| 3,605,537 | A | | 9/1971 | Pickler | |
| 3,628,412 | A | * | 12/1971 | Rogers, Jr. | 83/455 |
| 3,862,495 | A | * | 1/1975 | Market | 30/294 |
| 4,056,027 | A | | 11/1977 | Northrop | |
| 4,096,631 | A | * | 6/1978 | Ward | 30/294 |
| 4,429,461 | A | | 2/1984 | Glavic | |
| 4,685,366 | A | * | 8/1987 | Beder | 83/455 |
| 5,046,392 | A | | 9/1991 | Keon et al. | |
| 5,069,097 | A | * | 12/1991 | Mori | 83/56 |
| 5,086,680 | A | * | 2/1992 | Johnson | 83/167 |
| 5,214,852 | A | | 6/1993 | Napolitano | |
| 5,546,671 | A | * | 8/1996 | Kehoe | 33/648 |
| 5,924,348 | A | | 7/1999 | Schelli, III | |
| 6,053,085 | A | | 4/2000 | Lochkovic et al. | |
| 6,154,967 | A | | 12/2000 | Rogala | |
| D510,189 | S | * | 10/2005 | Greiner | D3/295 |
| 7,010,861 | B2 | * | 3/2006 | Nicholson | 33/42 |

* cited by examiner

*Primary Examiner*—Boyer D. Ashley
*Assistant Examiner*—Edward Landrum
(74) *Attorney, Agent, or Firm*—Kenneth H. Jack; Davis & Jack, LLC

(57) ABSTRACT

An insulation batt sizing device including an oblongated insulation cutting table having a proximal end, a distal end, and having a pair of longitudinally extending edges; an oblongated insulation compression plate having a proximal end, a distal end, and having at least a first longitudinally extending cut guiding edge; and a pivot hinge interconnecting the proximal ends of the oblongated insulation cutting table and the oblongated insulation cutting plate for pivotal motions between first and second positions, the oblongated insulation cutting plate extending upwardly while in the first position, the oblongated insulation cutting plate being co-extensive with the oblongated insulation cutting table while in the second position.

6 Claims, 7 Drawing Sheets

FIBERGLASS INSULATION BATT SIZING DEVICE

FIELD OF THE INVENTION

This invention relates to fiberglass insulation batt processing and installation. More particularly, this invention relates to apparatus adapted for assisting in the sizing and cutting of fiberglass insulation batts.

BACKGROUND OF THE INVENTION

Fiberglass insulation batts are typically installed within the exterior walls of commercial or residential structures for improving their thermal characteristics. Where, for example, such a wall comprises a typical frame including vertically oriented 2"×4" by 8' pine lumber studs spaced 24" on center, fiberglass insulation batts measuring approximately 8'×2'×4" are commonly provided as a factory pre-cut product. Such batts may be conveniently installed by stapling between such studs. Where such insulation batting must be installed above and below a window or above a doorway, the batting is necessarily trimmed or cut to a measured vertical lengths matching the vertical wall spacings presented above and below such structures.

Where, for example, a batt of insulation is to be installed within a vertical space between an exterior wall's foot board and a framed window's lower threshold, a carpenter typically measures the vertical length of such space and attempts to make a matching measured and laterally extending cut across an insulation batt. In attempting such matching measured cut, the carpenter typically lays the batt horizontally upon a bench or floor surface and utilizes a metal tape measure to mark a desired lateral cut line along the vertical length batt. However, such insulation batts do not present any solid corner or edge surface which is capable of securely engaging the tape measure's hook or tang. Thus, the carpenter must visually estimate an alignment of the tape measure's hook while observing and marking the cut line gradation. Estimating the placement of the hook end with respect to the batt, as opposed to solidly engaging the hook upon the batt, results in inaccurate placement of the tape measure end, and causes errors in measuring of the batt.

Following measuring, the carpenter typically draws a "line of sight" laterally extending cut line across the batt's paper backing with a pencil. Thereafter, the carpenter manually downwardly compresses the insulation toward the floor with one hand while progressively laterally cutting the insulation with a utility knife held by the other hand. Such common insulation sizing and cutting method commonly results in undesirable ragged and inaccurately cut edges.

The combined above described cutting inaccuracy factors associated with common insulation batt sizing processes undesirably result in insulation batt shortage or wastage.

The instant inventive fiberglass insulation batt sizing device solves or ameliorates problems discussed above by providing a mechanically simple tool for laterally compressing an insulation batt, for assisting in accurately measuring and locating a lateral cut line, and for guiding a compressed and straight lateral cut line across an insulation batt.

BRIEF SUMMARY OF THE INVENTION

A first structural component of the instant inventive fiberglass insulation batt sizing device comprises an oblongated insulation cutting table having a proximal end, a distal end, and having a pair of longitudinally extending lateral edges.

The oblongated insulation cutting table may suitably comprise a solid metal plate, or a plastic plate having metal surface embedded knife point slides, or a wooden plate similarly having such embedded knife points slides. However, the preferred configuration of the oblongated insulation cutting table comprises an aluminum extrusion having an "m" shaped lateral cross-sectional shape. Where an "m" aluminum extrusion is provided, at least a first structurally supporting and downwardly extending ridge is provided; and preferably, a plurality of such ridges are provided, such ridges forming the intermediate legs of the preferred "m" shaped cross-section. The upper surface of the web portion of the preferred aluminum "m" extrusion conveniently serves as a flat table top upon which insulation batts may be compressed and cut.

A second structural component of the instant invention comprises an oblongated insulation compression plate. Necessarily, such plate presents at least a first, and preferably a laterally opposed pair of substantially straight insulation batt cut guiding edges. The oblongated insulation compression plate may suitably comprise wood, plastic, or a composite laminate material. However, the compression plate preferably comprises a lower flange portion of a second aluminum extrusion, such extrusion preferably comprising an "I" extrusion.

A further structural component of the instant invention comprises hinged attaching means or pivotal mounting means, such means interconnecting proximal ends of the oblongated insulation cutting table and the oblongated insulation compression plate. Preferably, the hinged attaching means facilitates pivoting or hinged motions of the compression plate between first and second positions, the compression plate extending upwardly from the proximal end of the cutting table while in the first position, and the compression plate extending longitudinally along and co-extensively with the cutting table while in the second position.

Preferably, the oblongated insulation cutting table has a lateral dimension (perpendicular to the table's longitudinal dimension) which is greater than that of the oblongated insulation compression plate. Also preferably, the hinged attaching means further positions the compression plate so that, upon pivoting to the second position, the preferred pair of longitudinally extending cut guiding edges of the compression plate intermediately overlie the lateral edges of the cutting table. Such structural positioning, and such plate and table sizing advantageously allow a blade of a knife to be drawn longitudinally along the cut guiding edge while the knife point is received by and slides along the upper surface of the cutting table.

The hinged attaching means preferably further positions the compression plate with respect to the cutting table so that, upon pivoting of the compression plate to the second position, the proximal end of the compression plate is raised slightly above the cutting table's upper surface, such height differential advantageously facilitating even compression of an insulation batt along the longitudinal length of the table.

A further preferred structural component of the instant inventive insulation batt sizing device comprises a handle which is fixedly attached to or is wholly formed with the upper surface of the compression plate. Where the compression plate comprises the preferred "I" extrusion, the web and upper flange of such extrusion advantageously dually function as a handle and as a longitudinally extending structural stiffening member.

In order to enable the instant invention to better facilitate accurate measuring of insulation batts, the cutting table preferably presents at least a first, and preferably a plurality of tape measure hook engaging walls or surfaces. Preferably, such walls are positioned in substantial alignment with vertical planes including the compression plate's cut lines, such positioning allowing a tape measure having a hook engaged with one of such walls to accurately measure from a cut line. Preferably, such tape measure hook engaging walls comprise the walls of slots cut within the upper surface of the insulation cutting table, preferably at the table's proximal end. Suitably, the preferred tape measure hook engaging walls may alternately comprise an edge surfaces of lugs having expanded heads (similar to those presented by nail heads) or upwardly extending ridges which are fixedly attached to or are formed wholly with the cutting table.

A preferred hinged attaching means or pivotal mounting means for interconnecting the compression plate and cutting table comprises a plurality of aluminum sleeve extrusions, the bores of such extrusions being fitted for receipt of at least a first pivot pin. Preferably, such extruded hinged sleeves are vertically drilled to include rivet holes, and such sleeves are preferably fixedly riveted to proximal ends of the cutting table and compression plate.

In use of the instant inventive insulation batt sizing device, and assuming the provision of a preferred configuration as described above, an operator may place the device upon a floor surface or upon a work bench surface. Thereafter, the compression plate is pivotally moved to the first position. Thereafter, an insulation batt is lain laterally over the cutting table. Thereafter, the operator may engage the hook of a metal tape measure with the tape measure hook receiving slot, thereafter drawing the tape measure laterally to expose the desired length gradation. Thereafter, the operator may draw an end of the batt to a point coinciding with such gradation. Thereafter, the compression plate is moved to the second position, downwardly compressing the insulation batt against the cutting table. Thereafter, the operator may draw a utility knife longitudinally along the compression plate's cut guiding edge, neatly laterally severing the insulation batt at the desired measured length.

Accordingly, objects of the instant invention comprise the provision of an insulation batt sizing device having structures, features, and mechanical and functional advantages as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
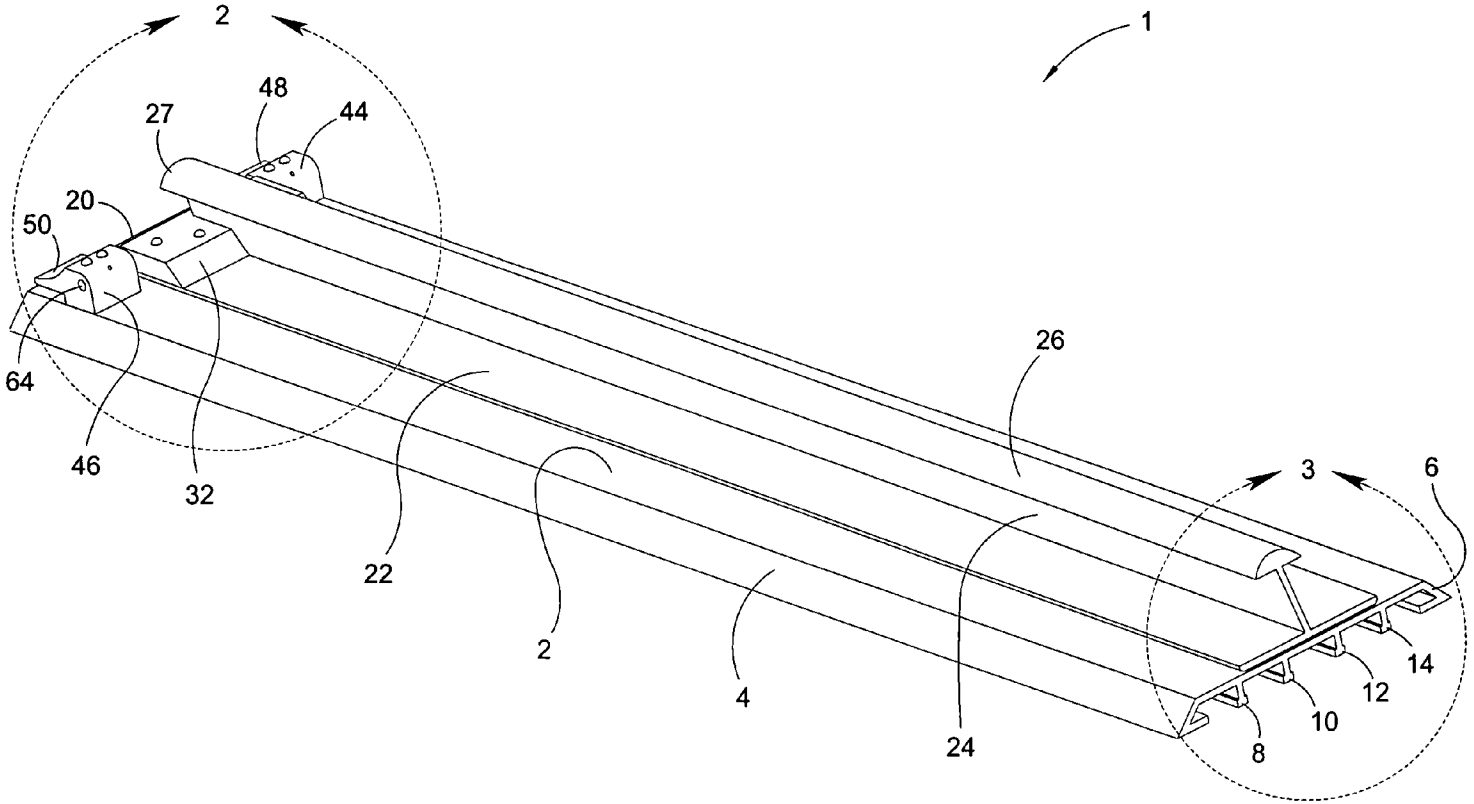
FIG. 1 is an isometric view of the instant inventive fiberglass insulation sizing device.
Figure 2:
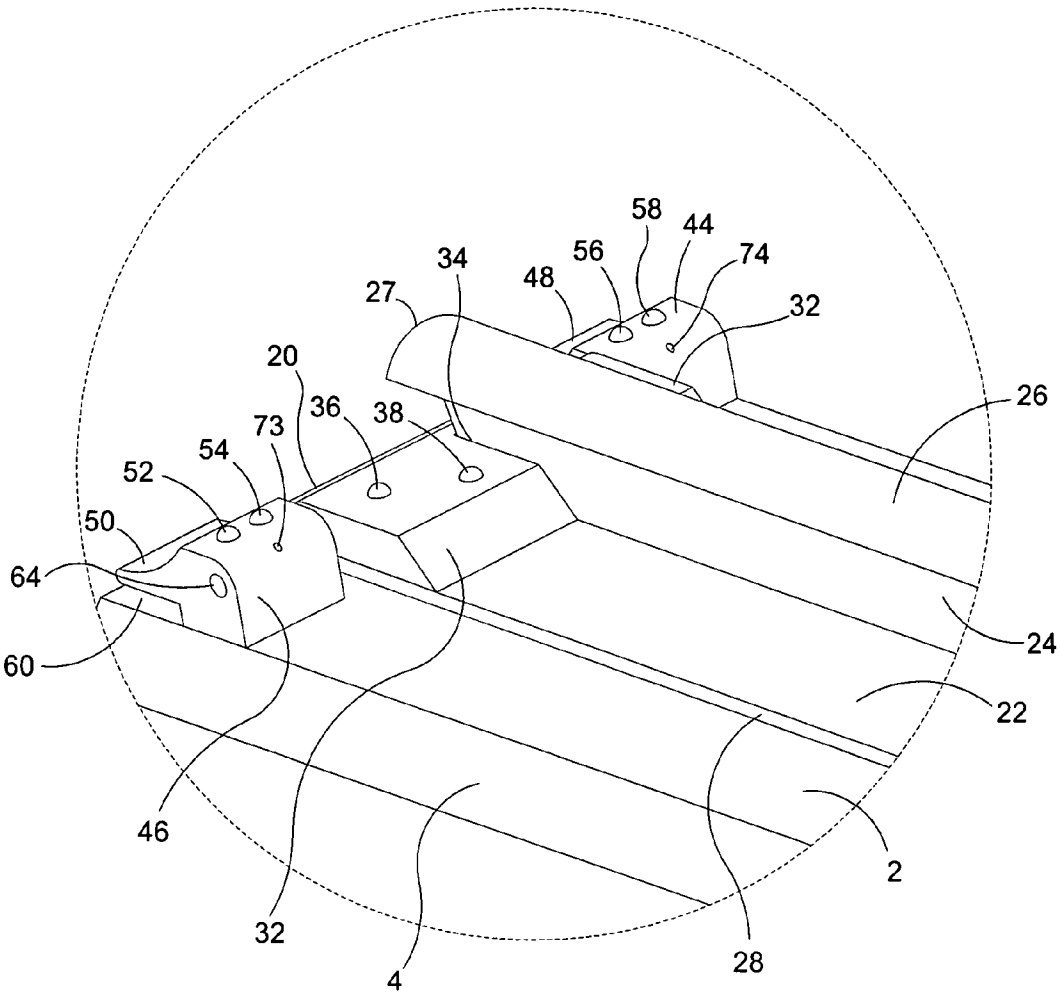
FIG. 2 includes a magnified detail, as indicated in FIG. 1.

Referring now to the drawings, and in particular to FIG. 1, the instant inventive fiberglass insulation batt sizing device is referred to generally by Reference Arrow. The device 1 has a longitudinally oblongated insulation cutting table 2. The cutting table 2 preferably has chamfered side edges 4 so that insulation batts drawn or dragged over the upper surface of table 2 will easily slide thereover without snagging or tearing. Preferably, referring simultaneously to FIGS. 1 and 7, the table 2 comprises an aluminum extrusion having an "m" shaped cross-sectional shape and having a plurality of intermediate legs or ridges 8, 10, 12, and 14. Referring further simultaneously to FIG. 2, the upper web of table 2 preferably has four rivet holes drilled vertically therethrough for receipt of rivets 52, 54, 56, and 58. Table 2 also preferably has tape measure hook receiving slots 16 and 18 cut longitudinally therein from the extreme proximal end for receipt of a hook 70 of a tape measure 72.

Figure 3:
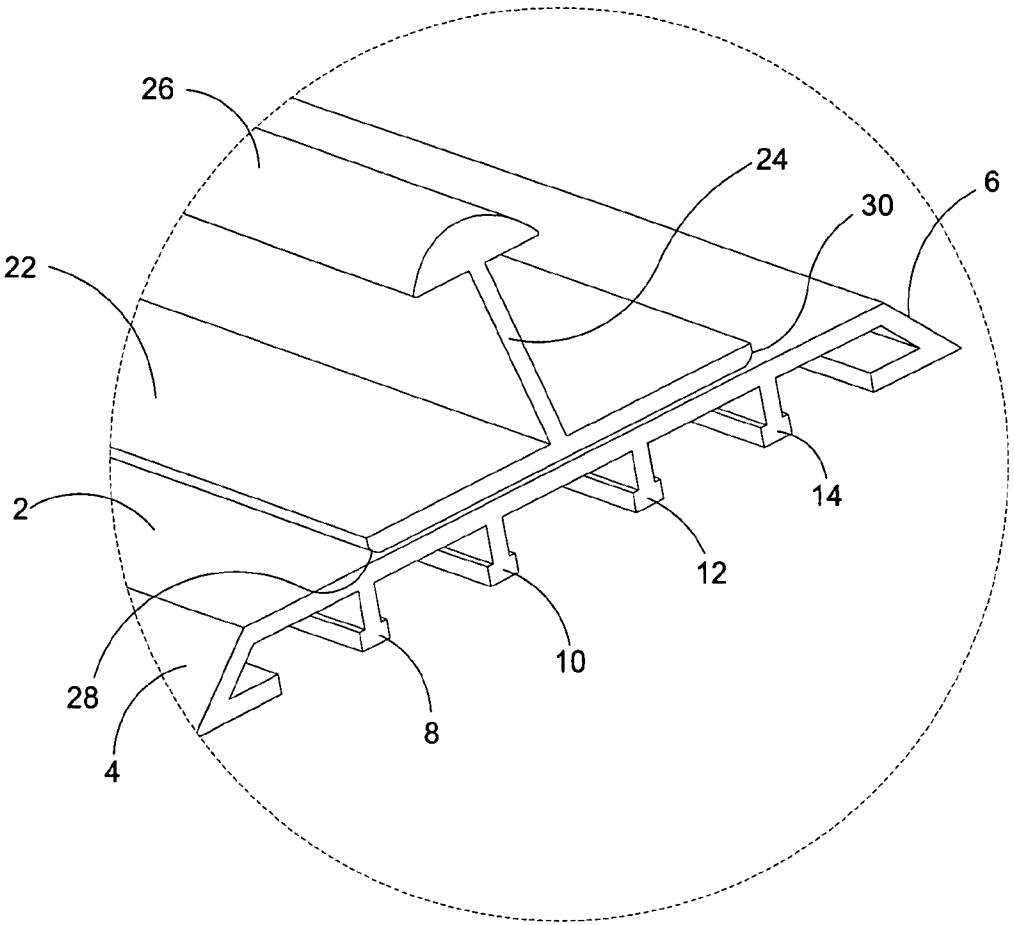
FIG. 3 includes a second magnified detail as indicated in FIG. 1.
Figure 7:
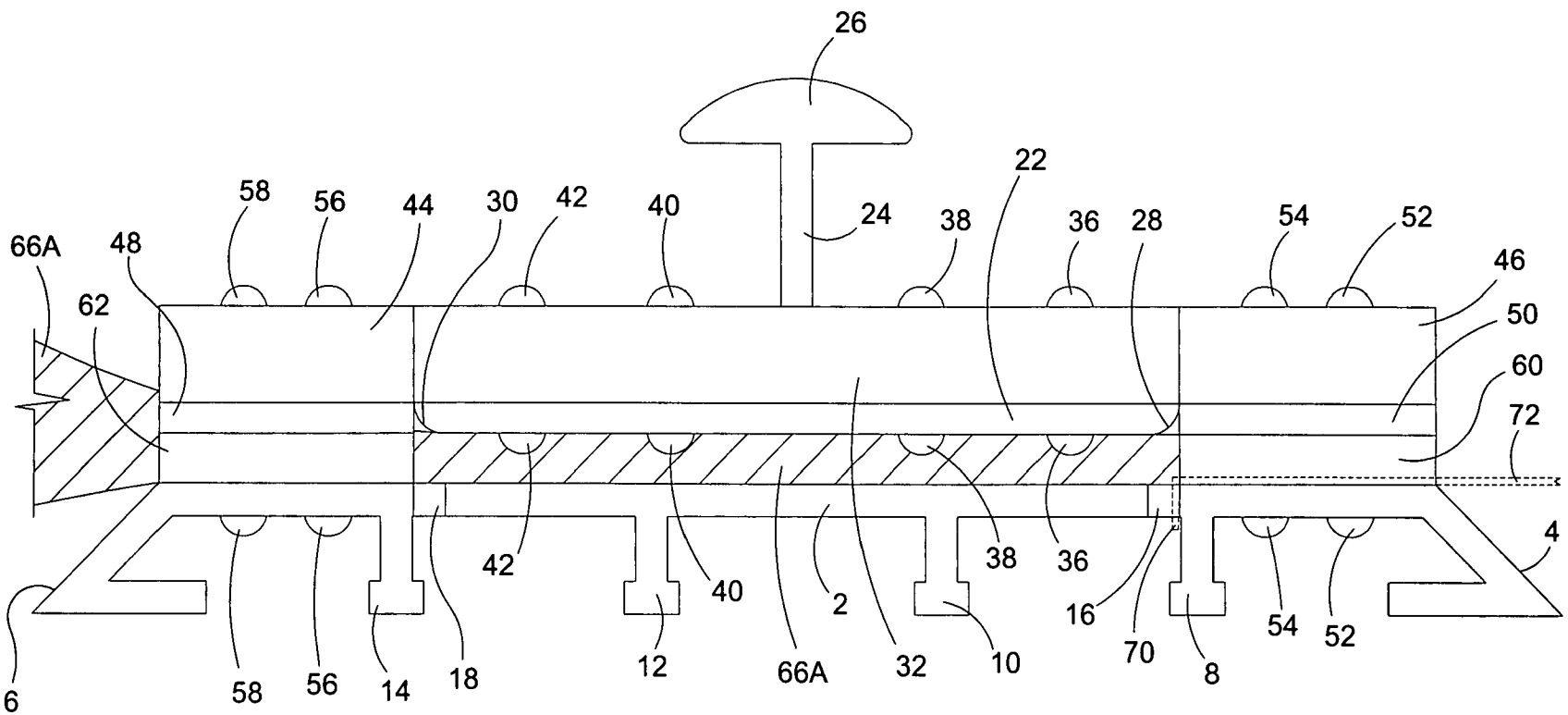
FIG. 7 is an end view of the device depicted in FIG. 6.

Referring again to FIG. 1, the device 1 preferably further comprises an "I" extrusion comprising a lower compressing plate flange 22, an upper handle flange 26, and a web 24. The web and upper flange 24 and 26 advantageously dually function as a stiffening member for reinforcing lower flange 22 and as a hand hold for manually pivotally raising and lowering flange 22. Referring further simultaneously to FIGS. 2 and 3, flange 22 preferably has laterally opposed cut guiding edges 28 and 30, such edges preferably being arcuately relieved for prevention of snagging or gouging insulation batt paper backings. Referring further simultaneously to FIG. 7, the flange 22 preferably further comprises four vertically extending rivet holes for receipt of rivets 36, 38, 40, and 42.

Referring simultaneously to FIGS. 1 and 2, proximal ends of the cutting table 2 and the compression plate 22 are preferably pivotally or hingedly interconnected by hinge sleeves 32, 44, and 46, and by hinge pins 64 extending laterally therethrough. Referring further simultaneously to FIG. 7, hinge sleeve 32 is preferably fixedly riveted in place upon flange 22 by rivets 36, 38, 40, and 42. Hinge sleeve 44 is preferably fixedly riveted in place upon the upper web of plate 2 by rivets 56 and 58, and sleeve 46 is similarly riveted in place by rivets 52 and 54. Referring in particular to FIG. 2, sleeve 32 preferably includes a slot 34 for fitted receipt of web 24.

Referring simultaneously to FIGS. 2 and 7, extruded hinge sleeve 46 preferably is formed to include a tape measure hook retention arm 50 which defines a tape measure receiving space 60 overlying the upper surface of table 2, immediately adjacent work slot 16. Sleeve 44 preferably similarly forms an arm 48 defining space 62 for facilitation of measuring in the opposite lateral direction. Referring in particular to FIG. 2, hinge pins 64 are preferably held against lateral sliding along the bores sleeves 44 and 46 by center punched or staked dimples 73 and 74.

Figure 4:
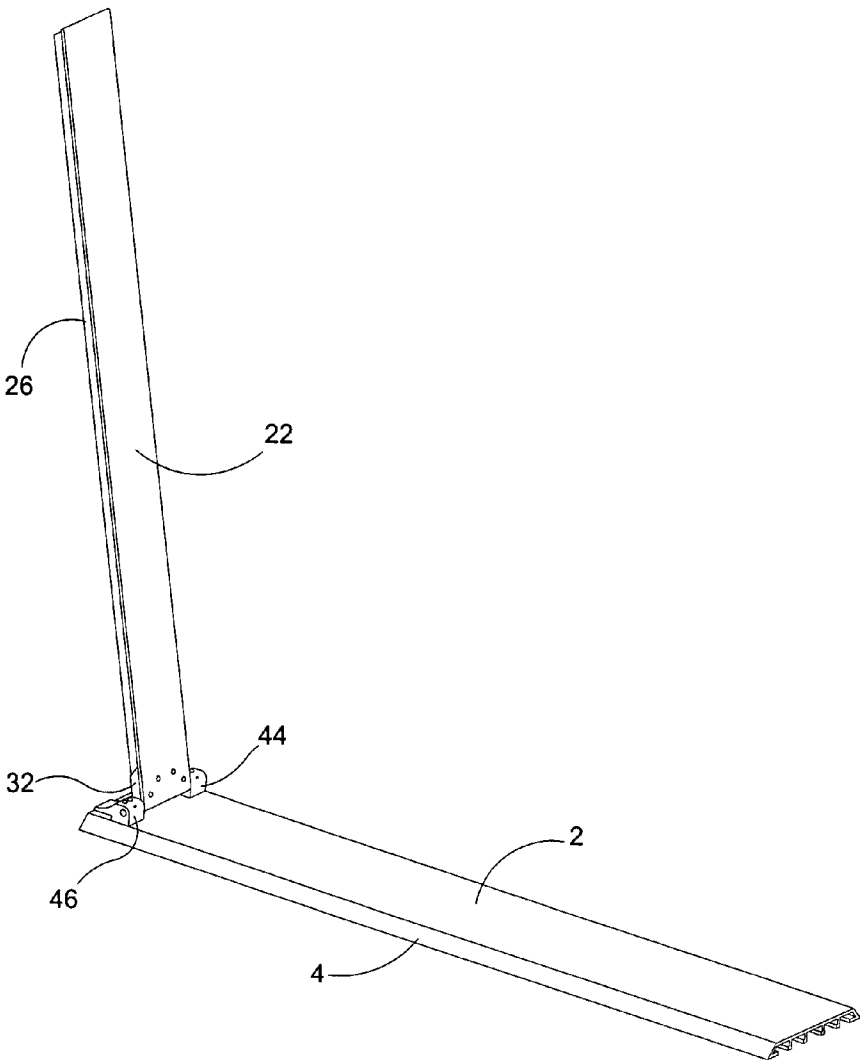
FIG. 4 redepicts FIG. 1, showing the device in an opened configuration.
Figure 5:
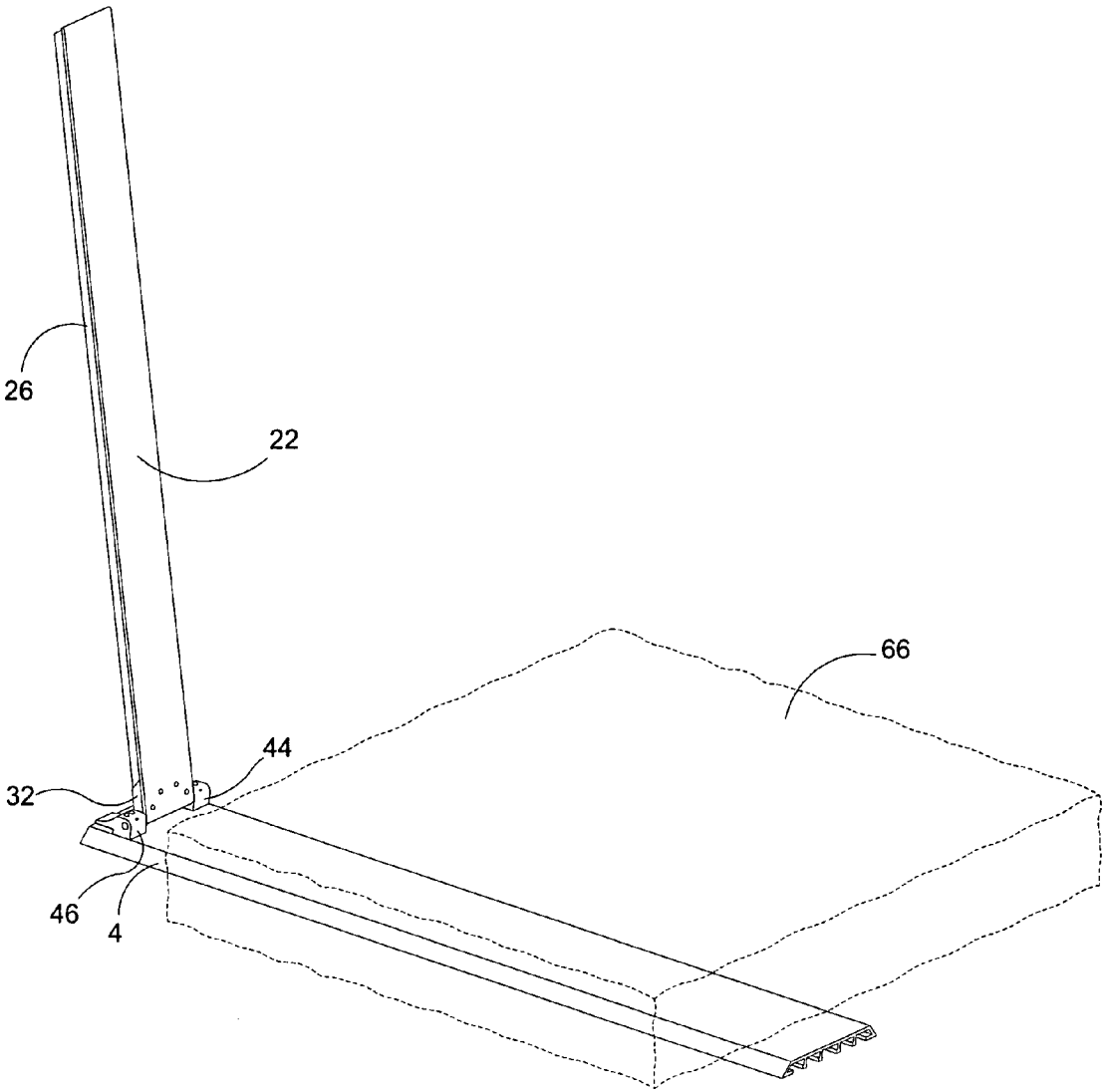
FIG. 5 redepicts FIG. 4, showing in ghost a fiberglass insulation batt.
Figure 6:
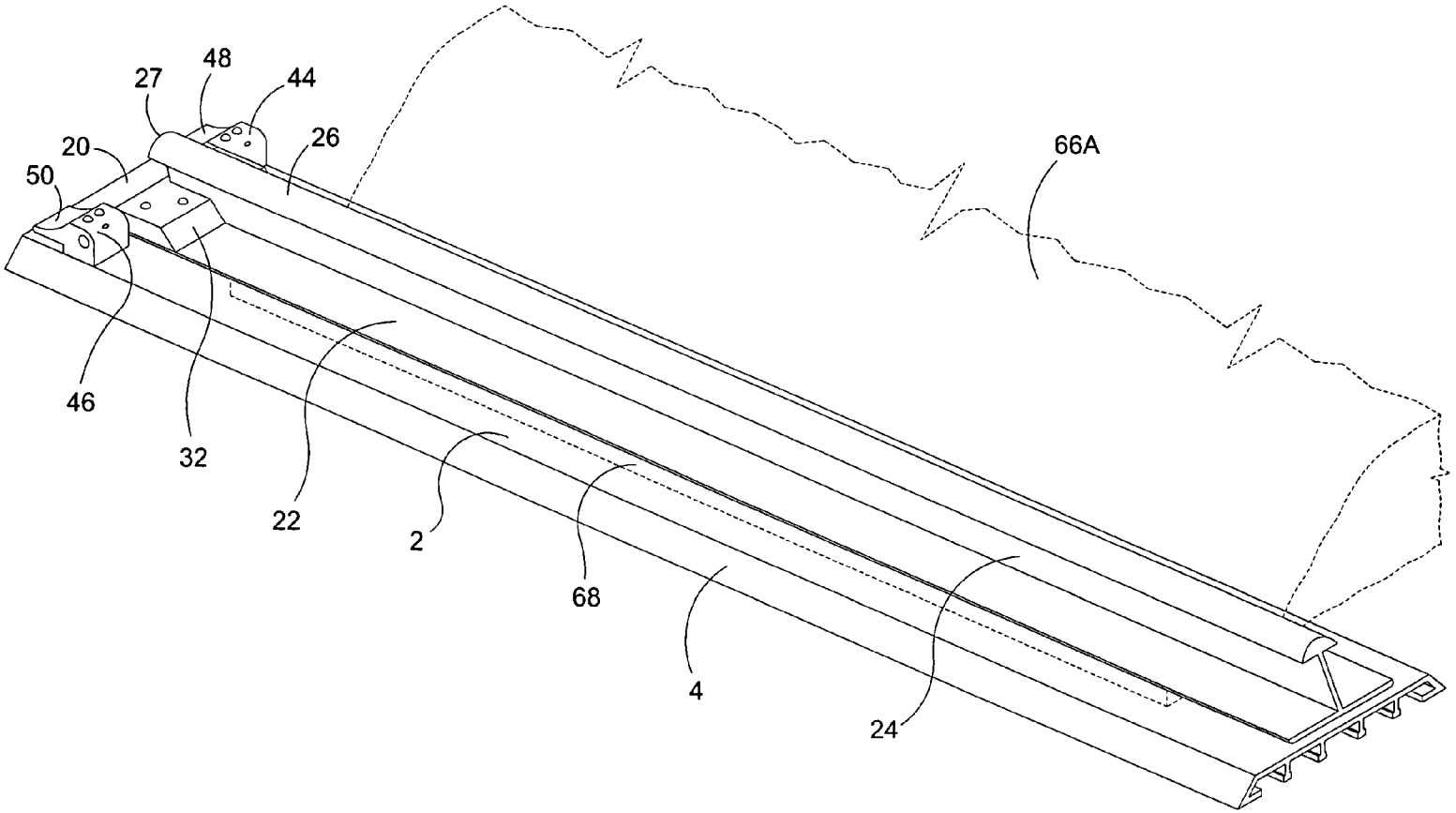
FIG. 6 redepicts FIG. 1, showing the fiberglass insulation batt compressed and cut.

In use of the instant inventive fiberglass insulation batt sizing device, referring to FIG. 4, handle flange 26 is manipulated to assume a first opened position as depicted in FIG. 4. In such first position, referring further to FIG. 6, the proximal end 27 of handle flange 26 preferably biases against the proximal end 20 of table 2, such biasing contact advantageously serving as a pivot stop. Preferably, the proximal end 27 is longitudinally fitted so that upon such biasing contact, flange 22 and handle 26 tilt slightly longitudinally rearwardly, allowing such member to remain at rest in the depicted upright position. Referring further simultaneously to FIG. 5, a batt of fiberglass insulation 66 may be placed over the upper surface of table 2 and, referring further to FIG. 7, an end of a metal tape measure 72 is extended beneath arm 50 of hinge sleeve 46 and within space 60, allowing hook 70 to downwardly extend into and engage a side wall of hook receiving slot 16, such side wall preferably lying substantially within the same vertical plane which includes cut guiding edge 28 of flange 22. Thereafter, the operator may laterally draw or extend the tape 72 exposing to view a desired length gradation. Thereafter, the operator may draw batt 66 laterally over the upper surface of table 2 until the end of batt 66 coincides with such length gradation. Thereafter, referring further to FIG. 6, the operator may pivot the flange/compression 22 plate and handle 26 to second position as depicted in FIG. 6, downwardly compressing the batt 66 to the newly compressed configuration 66A. Thereafter, the operator may downwardly press and draw a utility knife blade along edge 28, executing a desired clean and accurately measured cut 68.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. An insulation batt sizing device comprising:

(a) an oblongated insulation cutting table having an upper surface, a proximal end, a distal end, and having a pair of longitudinally extending edges;

(b) an oblongated insulation compression plate having a lower surface, a proximal end, a distal end, and having a longitudinally extending cut guiding edge;

(c) pivotal mounting means interconnecting the proximal ends of the oblongated insulation cutting table and the oblongated insulation compression plate for pivotal motions between first and second positions, the oblongated insulation compression plate extending upwardly and rearwardly from the oblongated insulation compression plate's proximal end while in the first position, the oblongated insulation compression plate being co-extensive with the oblongated insulation cutting table while in the second position, the pivotal mounting means upwardly displacing the proximal end of the oblongated insulation compression plate's lower surface with respect to the oblongated insulation cutting table's upper surface while the oblongated insulation compression plate is in the second position; and (d) a pivot stop positioned for resisting opening pivoting motion of the oblongated insulation compression plate at said first position, the pivot stop comprising a proximal end of a plate reinforcing handle, the plate reinforcing handle being fixedly attached to or formed wholly with the oblongated insulation compression plate, the plate reinforcing handle extending upwardly from the oblongated insulation compression plate and extending longitudinally along the oblongated insulation cutting table.

2. The insulation batt sizing device of claim 1 wherein the oblongated insulation compression plate comprises a second longitudinally extending cut guiding edge, the at least first and second longitudinally extending cut guiding edges being positioned, upon pivoting of the oblongated insulation compression plate to the second position, between the oblongated insulation cutting table's longitudinally extending edges.

3. The insulation batt sizing device of claim 2 further comprising first and second tape measure hook engaging walls fixedly attached to or formed wholly with the elongated insulation cutting table, the first and second tape measure hook engaging walls respectively having positions which substantially align with first and second vertical planes respectively containing the first and second longitudinally extending cut guiding edges.

4. The insulation batt sizing device of claim 3 further comprising first and second slots within the oblongated insulation cutting table, the first and second slots respectively comprising the first and second tape measure hook engaging walls.

5. The insulation batt sizing device of claim 1 further comprising a tape measure hook engaging wall fixedly attached to or formed wholly with the oblongated insulation cutting table, the tape measure hook engaging wall being positioned in substantial alignment with a vertical plane containing the longitudinally extending cut guiding edge.

6. The insulation batt sizing device of claim 5 further comprising a slot within the oblongated insulation cutting table, the slot comprising the tape measure hook engaging wall.

* * * * *